US009937981B2

(12) United States Patent
Favaro et al.

(10) Patent No.: US 9,937,981 B2
(45) Date of Patent: Apr. 10, 2018

(54) DECOMPRESSION BUOY

(71) Applicant: DECATHLON, Villeneuve D'Ascq (FR)

(72) Inventors: Julien Favaro, Boucau (FR); Stéphano Moretto, Saint Jean de Luz (FR); Cédric Caprice, Biarritz (FR)

(73) Assignee: DECATHLON, Villeneuve D'Ascq (FR)

( * ) Notice: Subject to any disclaimer, the term of this patent is extended or adjusted under 35 U.S.C. 154(b) by 0 days.

(21) Appl. No.: 15/227,980

(22) Filed: Aug. 4, 2016

(65) Prior Publication Data

US 2017/0036741 A1 Feb. 9, 2017

(30) Foreign Application Priority Data

Aug. 7, 2015 (FR) ..... 15 57626

(51) Int. Cl.
*B63B 22/22* (2006.01)
*B63C 11/26* (2006.01)
*B63C 7/26* (2006.01)

(52) U.S. Cl.
CPC ..... *B63B 22/22* (2013.01); *B63C 11/26* (2013.01); *B63B 2201/00* (2013.01); *B63C 7/26* (2013.01)

(58) Field of Classification Search
CPC ..... B63C 11/26; B63B 22/08; B63B 22/12; B63B 22/22; B63B 2201/00; B63B 2207/00; B63B 2207/02; B63B 2207/04; B63B 2738/00; B63B 2738/02
USPC ..... 441/30
See application file for complete search history.

(56) References Cited

U.S. PATENT DOCUMENTS 2,887,080 A * 5/1959 Fedrowich ..... B63C 7/10 114/54
3,149,352 A 9/1964 Christiansen
3,777,498 A * 12/1973 Andrews ..... B63C 11/52 383/10
4,475,476 A 10/1984 Howard
5,092,327 A * 3/1992 Tragatschnig ..... B63C 11/20 128/201.27
5,231,952 A * 8/1993 Tenniswood ..... B63B 22/12 116/210
5,735,719 A 4/1998 Berg
(Continued)

FOREIGN PATENT DOCUMENTS

CN 201080243 Y 7/2008
CN 203780776 U 8/2014
(Continued)

*Primary Examiner* — Daniel V Venne
(74) *Attorney, Agent, or Firm* — MH2 Technology Law Group, LLP

(57) ABSTRACT

The present invention relates to a decompression buoy (1) comprising an inflatable bag (2) having a tubular portion (4) defining a an inside volume (12) and a longitudinal opening portion (6) with a first end (14) leading to the inside volume (12) and a second end (16) leading to the outside. The opening portion (6) thus enables gas to flow between the outside and the inside volume (12). The opening portion (6) includes a throat (18) of transverse dimension that is smaller than the transverse dimension of the first end (14), and the second end (16) is adapted to receive the end of a diving regulator.

9 Claims, 2 Drawing Sheets

(56) References Cited

U.S. PATENT DOCUMENTS

| | | | | |
|---|---|---|---|---|
| 6,080,027 | A * | 6/2000 | Rodemann | B63B 43/12<br>441/38 |
| 8,508,382 | B1 | 8/2013 | Novak | |
| 2015/0136012 | A1 * | 5/2015 | Williams | B63G 8/001<br>114/312 |

FOREIGN PATENT DOCUMENTS

| | | | |
|---|---|---|---|
| FR | 2988371 | A1 | 9/2013 |
| GB | 2353006 | A | 2/2001 |
| GB | 2484714 | A | 4/2012 |
| WO | 2010/135762 | A1 | 12/2010 |

* cited by examiner

DECOMPRESSION BUOY

BACKGROUND OF THE INVENTION

The present invention relates to the field of undersea diving, and in particular to the field of decompression buoys used during undersea diving.

A decompression buoy is equipment used in undersea diving during a decompression stop. It serves to provide a mark at the surface showing the position of the diver at the end of a dive, and that a diver is returning to the surface with safety stops. The decompression buoy also enables a diver to stay in position at a constant depth in open water so as to facilitate the stop.

Conventionally, a decompression buoy comprises an inflatable bag of generally cylindrical shape and a retaining line connecting the bag when inflated to the diver whose presence it serves to indicate. The decompression buoy is designed to float vertically at the surface of the water and it is of bright color (orange or yellow) so as to be visible to third parties present at the surface of the water.

In order to facilitate inflation of the decompression buoy underwater by the diver, the decompression buoy conventionally includes a large opening at its base. The large opening makes it easier for the diver to put the diving regulator into the opening in order to inflate the decompression buoy.

Nevertheless, when the decompression buoy is in use and floating at the surface of the water in the inflated state, it can sag or lie down on the surface of the water. This happens in particular when the tension exerted by the diver on the retaining means is insufficient or when the decompression buoy on the surface is subjected to a large amount of swell or to a strong wind. Under such circumstances, the large opening can lead to the decompression buoy deflating, thus making it inoperative.

In order to solve such a problem, it is known to fit a decompression buoy with a check valve that is positioned in the proximity of the large opening: the check valve prevents the decompression buoy from deflating. Nevertheless, it is also necessary to provide a pressure release valve to prevent the buoy exploding as it rises to the surface, thereby increasing the cost of fabrication and the overall size of the decompression buoy. Finally, deflating the decompression buoy is also made more complicated by the presence of the check valve.

There thus exist decompression buoys, e.g. the Mares surface marker buoy (SMB), that are cylindrical in shape with ballast means at the opening. Such buoys are geometrically shaped so that inflating the buoy into shape leads to the opening becoming pinched, thereby closing the buoy to an extent that is proportional to the pressure inside the buoy: this produces a check valve effect that prevents air from escaping through the opening. A pressure release valve is then necessary firstly in order to avoid the buoy exploding while it is rising and secondly to enable the buoy to be deflated so that it can be stored.

OBJECT AND SUMMARY OF THE INVENTION

The present invention seeks to solve the various above-mentioned technical problems. In particular, the present invention seeks to provide a decompression buoy that is easy to fabricate and to store, and that limits any risk of deflating at the surface of the water when it cannot remain upright.

Thus, in one aspect, there is provided a decompression buoy comprising an inflatable bag having a tubular portion defining an inside volume and an opening portion with a first end leading to the inside volume and a second end leading to the outside, the opening portion thus enabling gas to flow between the outside and the inside volume. The opening portion includes a throat of transverse dimension that is smaller than the transverse dimension of the first end, and the second end is adapted to receive the end of a diving regulator.

Because of the throat in the opening portion, it is possible to limit deflation of the decompression buoy when it sags or lies down on the surface of the water. Specifically, the section for air flow through the throat is smaller and thus limits the rate at which air passes through it. Furthermore, such a throat requires less force in order to become folded and to close itself as a result of folding: it is therefore at the throat that the decompression buoy folds on sagging or on lying down on the surface of the water, thereby reducing any risk of deflation. Finally, such a throat nevertheless does not prevent air from escaping from the decompression buoy when that is necessary, in particular while the decompression buoy is rising to the surface (in order to avoid any risk of explosion), or while the decompression buoy is being stored. Specifically, it is not geometrical constraints acting on the opening of the inflated buoy that enable the throat to be closed, but folding of the buoy that leads to the throat being closed temporarily. It then suffices to unfold the buoy in order to reopen the throat.

Preferably, the opening portion does not have any mechanical closure means fitted thereto. The absence of fitted mechanical closure means limits any risk of faults during fabrication, and also limits fabrication costs. The resulting decompression buoy is also more compact and lighter in weight, thereby making it easier to transport.

Preferably, the transverse dimension of the first end is equal to the transverse dimension of the second end of the opening portion. Such a characteristic facilitates inflating the decompression buoy: specifically, even if the transverse dimension of the throat is small and limits the rate at which air can pass therethrough, the diver can still easily inflate the decompression buoy underwater by placing the diving regulator in the flared second end of the opening portion and allowing air to fill the decompression buoy progressively.

Preferably, the opening portion also includes, between the first end and the throat, a first fraction converging towards the throat from the first end. The converging first fraction is provided to limit the stresses acting on the opening portion at its throat. Thus, even if the transverse dimension of the throat is narrower than the transverse dimension of the decompression buoy, the stress acting on the throat are distributed over a larger area and make it possible to avoid or to limit any added mechanical reinforcement at the throat.

Preferably, the first fraction extends over a length lying in the range 0.5 to 2 times the transverse dimension of the first end. Such a length makes it possible to limit the stresses that act on the throat.

Preferably, the opening portion also includes, between the second end and the throat, a second fraction that diverges from the throat towards the second end. The second fraction also serves to limit stresses acting on the throat and to direct air towards the throat when inflating the decompression buoy. Nevertheless, the second fraction is subjected to less stress and it may be shorter than the first fraction in order to limit the length of the opening portion.

Preferably, the throat of the bag presents, on its inside surface, a material that is configured to adhere reversibly with itself by contact, this material being for example the material that forms the throat of the bag or being a material that is fitted to the inside surface of the material that forms the throat of the bag. The material of the inside surface of the throat is selected so as to adhere easily to itself in order to further reduce the flow rate of air that might escape from the buoy through the throat: this serves firstly to further limit any risk of the decompression buoy deflating on the surface of the water and also encourages the buoy to fold at its throat when the decompression buoy is caused to sag or to lie down on the surface of the water. By way of example, the throat material may be a polyamide coated on its inside surface in polyurethane. Adhesion between the inside surfaces of the throat remains reversible, and cannot withstand a given value for pressure inside the buoy when it is not folded: it thus remains easy to deflate the buoy in order to store it.

Preferably, the tubular portion of the bag is cylindrical in shape, with a transverse dimension that is substantially constant. The transverse dimension of the tubular portion is substantially equal to the transverse dimension of the first end.

Preferably, the decompression buoy is formed by a panel folded in half, e.g. by high frequency sealing or by heat-sealing, or by a plurality of panels assembled together, e.g. by high frequency sealing or by heat-sealing. It can thus be seen that the presence of the throat in the opening portion does not add complication to the method of fabricating the decompression buoy, which can continue to be fabricated by high frequency sealing or by heat-sealing, but following specific shapes.

Preferably, the decompression buoy also has retaining means, such as a line.

Preferably, the line is mounted on the opening portion of the inflatable bag, preferably between the throat and the second end of the opening portion, or on means, e.g. storage means, that are fastened to the inflatable bag between the throat and the second end of the opening portion. The position of the retaining means between the throat and the second end of the opening portion makes it possible and easy to fold the opening portion at the throat, when the axis of the decompression buoy is inclined relative to the direction of the throat, i.e. when the decompression buoy is caused to lean over or to lie down on the surface of the water.

BRIEF DESCRIPTION OF THE DRAWINGS

The invention and its advantages can be better understood on reading the following detailed description of a particular embodiment given by way of non-limiting example and illustrated in the accompanying drawings, in which.

DETAILED DESCRIPTION OF THE INVENTION

Figure 1:
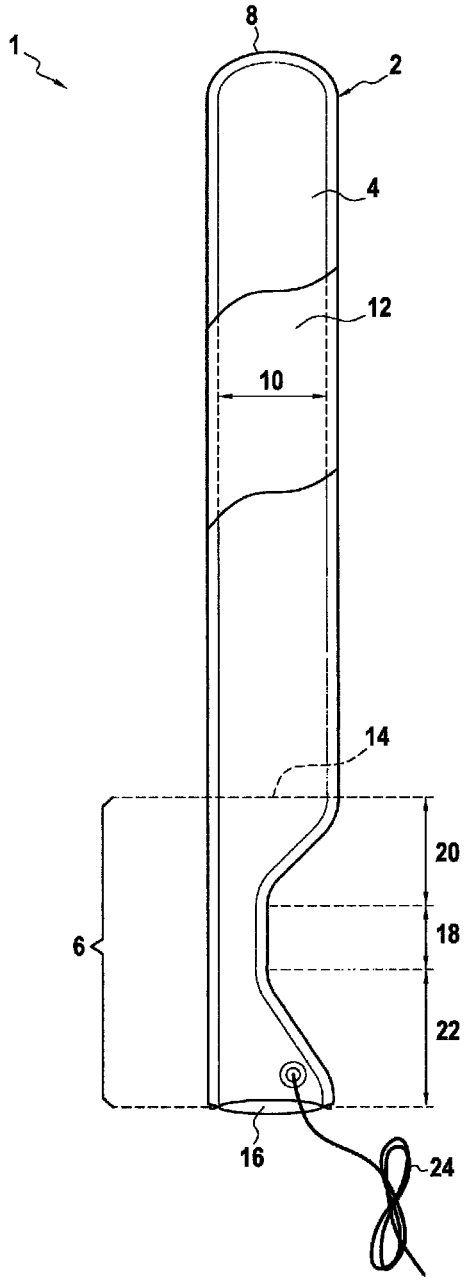
FIG. 1 is a diagrammatic view of an embodiment of a decompression buoy of the invention, in the deflated state.

FIG. 1 shows a decompression buoy 1 in accordance with the invention. The decompression buoy 1 comprises an inflatable bag 2 presenting a tubular portion 4 and an opening portion 6.

The tubular portion 4 is of generally longitudinal shape, closed at its top end 8 and open at its bottom via which the tubular portion 4 is in fluid flow connection with the opening portion 6. Preferably, the tubular portion 4 is of generally tubular or cylindrical shape, with a transverse dimension 10, i.e. a length in a plane perpendicular to the longitudinal direction of the tubular portion 4, that is substantially constant over the length of the tubular portion 4. In particular, the length and the outside color of the tubular portion 4 are selected so that the decompression buoy is clearly visible at the surface of the water when it is in use.

Furthermore, the tubular portion 4 defines an inside volume 12 in fluid flow communication via the bottom end of the tubular portion 4 with the opening portion 6.

The opening portion 6 is of longitudinal shape with a first end 14 and a second end 16. The first end 14 is in fluid flow communication with the tubular portion 4 via the bottom end of the tubular portion 4 and thus leads to the inside volume 12. The first end 14 may in particular present a transverse dimension, i.e. a length in a plane perpendicular to the longitudinal direction of the opening portion, that is equal to the transverse dimension of the tubular portion 4. The second end 16 leads to the outside of the decompression buoy 1. The opening portion 6 thus makes it possible to put the inside volume 12 into communication with the outside. The second end 16 may in particular be adapted, e.g. dimensioned, in such a manner as to enable it to receive the end of a diving regulator in order to inflate the decompression buoy 1. Thus, the second end 16 may have a transverse dimension that is substantially identical to that of the first end 14, as shown in FIG. 1.

The opening portion 6 likewise also includes, between the first end 14 and the second end 16, a narrowing or throat 18 where the transverse dimension is less than that of the first end 14. More precisely, and as shown in FIG. 1, it is assumed in the description below that the throat 18 is the fraction of the opening portion 6 that presents the smallest transverse dimension, which dimension is substantially constant.

Furthermore, the opening portion 6 includes, between the first end 14 and the throat 18, a first fraction 20 that converges from the first end 14 towards the throat 18. The first fraction 20 serves to provide a connection between the first end 14 and the throat 18 of varying transverse dimension. The first fraction 20 serves in particular to spread stresses, in particular due to the pressure inside the inside volume 12 and acting on the walls of the opening portion 6 in the throat 18. Thus, the first fraction 20 presents a converging shape extending over a length that is substantially equal to the transverse dimension 10 of the inside volume 12 and substantially equal to three times the transverse dimension of the throat 18, as shown in FIG. 1. More generally, the first fraction 20 may extend over a length lying in the range 0.5 to 2 times the transverse dimension of the first end.

Between the second end 16 and the throat 18, the opening portion 6 comprises a second fraction 22 that diverges from the throat towards the second end 16. The second fraction 22 serves to provide a second end 16 of flared shape that enables the end of a diving regulator to be received in order to facilitate inflating the buoy 1.

Figure 2:
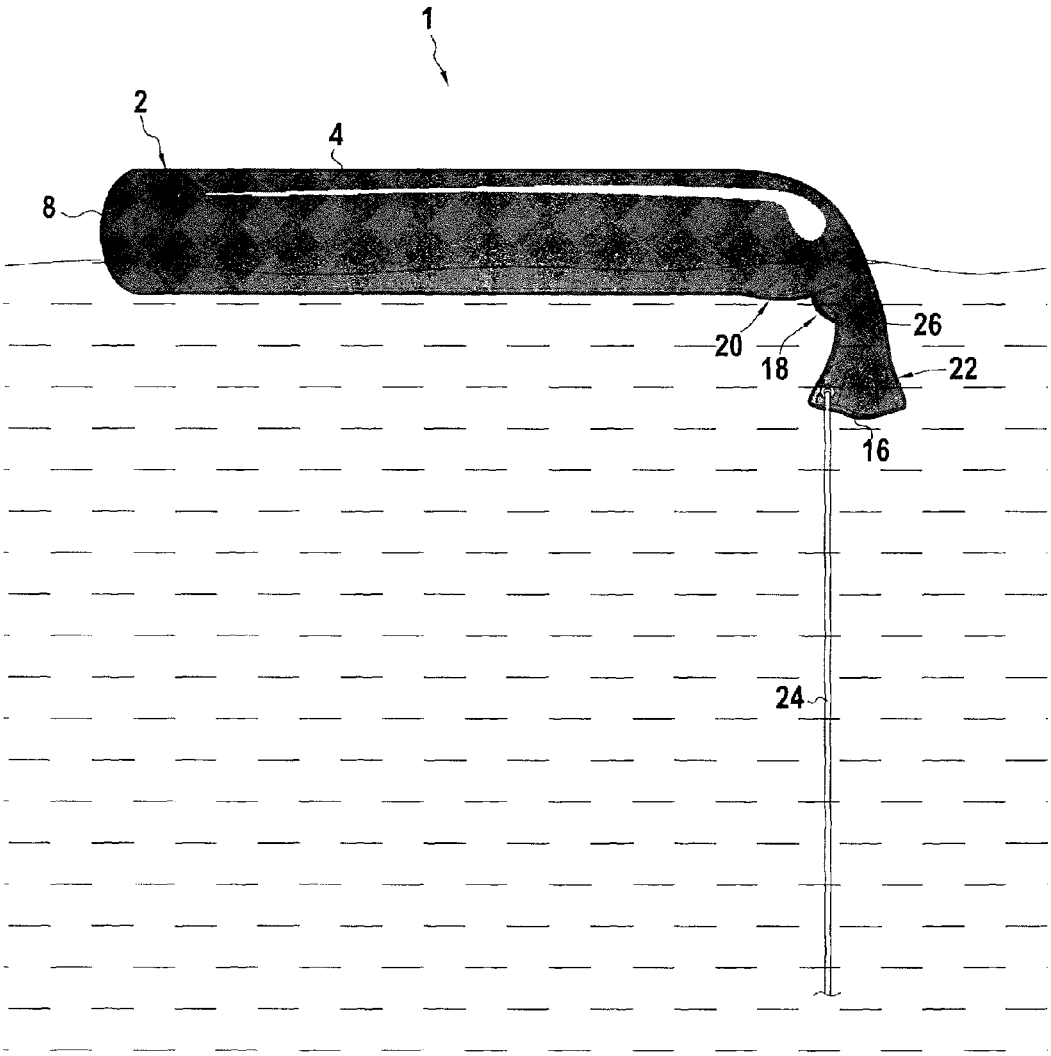
FIG. 2 is a diagrammatic view of the decompression buoy of FIG. 1, in the inflated state, when lying on the surface of the water.

Finally, the decompression buoy 1 includes retaining means 24. The retaining means 24 enable the diver to remain connected to the decompression buoy 1 and to retain it while it is at the surface of the water. The retaining means 24 are conventionally constituted by a line. In the present invention, the retaining means 24 are connected to the bag 2 via the opening portion 6, and preferably between the throat 18 and the second end 16, i.e. to the second fraction 22. When the retaining means exert pressure on the bag 2 and when the decompression buoy 1 in the inflated state tends to sag or lie down on the surface of the water (see FIG. 2), such an arrangement enables the bag 2 to fold at the throat 18, thereby forming a fold line 26 that reinforces the air tightness of the throat 18 in the opening portion 6, thereby limiting leaks of air. Specifically, at the fold line 26, the inside walls of the throat 18 that face each other come into contact with each other and thus limit the passage of air.

Alternatively, the retaining means 24 may be mounted on the bag 2 via other means, e.g. storage means (not shown) mounted on the bag 2 via the opening portion 6, and preferably between the throat 18 and the second end 16, i.e. on the second fraction 22.

As can be seen in FIG. 1, the decompression buoy 1, and more particularly its opening portion 6, does not have any mechanical closure means such as a check valve added thereto. This avoids having a decompression buoy that is too bulky and heavy. This also avoids problems of reliability concerning the fastening of the check valve to the remainder of the decompression buoy 1.

The bag 2, and more generally the decompression buoy 1, is conventionally formed by one or more panels of textile material that are sealed to one another or to itself so as to obtain the desired generally tubular shape. In particular, FIG. 1 shows a bag 2 that is obtained from two identical panels that are sealed together along their peripheral margin by heat-sealing, in particular by high frequency sealing. Each of the panels is of the same general shape as the bag 2 of the decompression buoy 1 when flat, i.e. a main portion and a constriction. In particular, the transverse dimension of the throat 18 is selected so as to enable the fold line 26 to be formed in said throat 18 while not excessively lengthening the time required to inflate the decompression buoy.

Furthermore, in order to improve the air tightness of the throat 18, the panel(s) forming the bag 2 may have a material on their inside surfaces in the throat 18, e.g. a smooth and adhesive material, that encourages reversible adhesion between the two facing walls of the throat 18. The smooth and adhesive material then increases contact between the two facing walls and thus reduces the passage of air through the throat 18. The smooth and adhesive material may be obtained from an internal coating, e.g. of polyurethane on a polyamide support, that imparts the desired adhesive properties locally. Alternatively, the material of the panels of the bag may be selected from the start to present the desired adhesive properties. Under such circumstances, the inside surfaces of the bag may adhere to each other over the entire length of the bag, but in practice they are caused to adhere only at the fold line 26.

Thus, the decompression buoy of the present invention makes it possible to limit the risk of the decompression buoy deflating when it is floating the surface of the water. Furthermore, such a decompression buoy presents a saving in weight, little bulk, better reliability, and greater ease of use in comparison with prior art decompression buoys, because of the absence of any fitted element of the heat-sealed valve type.

The invention claimed is:

1. A decompression buoy comprising:

an inflatable bag having a tubular portion defining an inside volume and an opening portion with a first end leading to the inside volume and a second end leading to an outside, the opening portion thus enabling gas to flow between the outside and the inside volume, wherein the opening portion includes a throat of transverse dimension that is smaller than a transverse dimension of the first end and a transverse dimension of the second end, and wherein the opening portion also includes, between the first end and the throat, a first fraction converging towards the throat from the first end; and a line mounted on the opening portion of the inflatable bag.

2. The decompression buoy according to claim 1, wherein the opening portion does not have any mechanical closure fitted thereto.

3. The decompression buoy according to claim 1, wherein the transverse dimension of the first end is substantially equal to the transverse dimension of the second end of the opening portion.

4. The decompression buoy according to claim 1, wherein the first fraction extends over a length lying in a range 0.5 to 2 times the transverse dimension of the first end.

5. The decompression buoy according to claim 1, wherein the opening portion also includes, between the second end and the throat, a second fraction that diverges from the throat towards the second end.

6. The decompression buoy according to claim 1, wherein the tubular portion of the inflatable bag is cylindrical in shape, with a transverse dimension that is substantially constant.

7. The decompression buoy according to claim 6, wherein the transverse dimension of the tubular portion is substantially equal to the transverse dimension of the first end.

8. The decompression buoy according to claim 1, wherein the line is mounted on the inflatable bag between the throat and the second end of the opening portion.

9. A decompression buoy comprising:

an inflatable bag having a tubular portion defining an inside volume and an opening portion with a first end leading to the inside volume and a second end leading to an outside, the opening portion thus enabling gas to flow between the outside and the inside volume, wherein the opening portion includes a throat of transverse dimension that is smaller than a transverse dimension of the first end and a transverse dimension of the second end; and a line mounted on the opening portion of the inflatable bag, between the throat and the second end of the opening portion.

* * * * *